US009267456B2

(12) United States Patent
Mohammed et al.

(10) Patent No.: US 9,267,456 B2
(45) Date of Patent: Feb. 23, 2016

(54) EMISSIONS REDUCTIONS THROUGH REGENT RELEASE CONTROL

(71) Applicant: Cummins Inc., Columbus, IN (US)

(72) Inventors: Hasan Mohammed, Bloomington, IN (US); Joseph M. Brault, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 14/183,706

(22) Filed: Feb. 19, 2014

(65) Prior Publication Data

US 2014/0165557 A1 Jun. 19, 2014

Related U.S. Application Data

(63) Continuation of application No. 12/902,615, filed on Oct. 12, 2010, now Pat. No. 8,689,542.

(51) Int. Cl.

| | |
|---|---|
| ***F01N 3/00*** | (2006.01) |
| ***F01N 3/02*** | (2006.01) |
| ***F01N 3/10*** | (2006.01) |
| ***F01N 3/20*** | (2006.01) |

(Continued)

(52) U.S. Cl.

CPC ..... *F02D 41/0235* (2013.01); *F01N 3/206* (2013.01); *F02D 41/0275* (2013.01); *F01N 3/208* (2013.01); *F01N 11/00* (2013.01); *F01N 2550/02* (2013.01); *F02B 37/013* (2013.01); *F02D 41/1462* (2013.01); *F02D 2250/36* (2013.01)

(58) Field of Classification Search

USPC ..... 60/286, 295, 299, 301

See application file for complete search history.

(56) References Cited

U.S. PATENT DOCUMENTS 6,311,484 B1 11/2001 Roth et al.
6,415,602 B1 7/2002 Patchett et al.

(Continued)

OTHER PUBLICATIONS

International Search Report and Written Opinion, PCT/US2011/055914, ISA/US, Cummins Inc., Feb. 21, 2012.

*Primary Examiner* — Audrey K Bradley
*Assistant Examiner* — Dapinder Singh
(74) *Attorney, Agent, or Firm* — Taft, Stettinius & Hollister LLP

(57) ABSTRACT

One embodiment is a method including determining whether an ammonia storage device has a stored quantity of ammonia, predicting an impending ammonia release from the ammonia storage device, determining a $NO_x$ increase amount in response to the impending ammonia release, and increasing an amount of $NO_x$ provided by an engine based on the $NO_x$ increase amount. In certain embodiments, determining the $NO_x$ increase amount in response to the impending ammonia release comprises determining a $NO_x$ increase schedule based on the stored quantity of ammonia. In certain embodiments, the $NO_x$ increase schedule comprises a specified $NO_x$ increase time period, and in certain further embodiments, the method further includes decrementing the specified $NO_x$ increase time period based on an estimated catalyst degradation value.

10 Claims, 5 Drawing Sheets

(51) Int. Cl.

| | |
|---|---|
| ***F02D 41/02*** | (2006.01) |
| *F01N 11/00* | (2006.01) |
| *F02B 37/013* | (2006.01) |
| *F02D 41/14* | (2006.01) |

(56) References Cited

U.S. PATENT DOCUMENTS

| | | | |
|---|---|---|---|
| 6,442,932 | B1 | 9/2002 | Hofmann et al. |
| 6,532,736 | B2 | 3/2003 | Hammerle et al. |
| 6,662,553 | B2 | 12/2003 | Patchett et al. |
| 6,882,929 | B2 | 4/2005 | Liang |
| 6,981,368 | B2 | 1/2006 | van Nieuwstadt et al. |
| 6,993,900 | B2 | 2/2006 | Upadhyay et al. |
| 2004/0098974 | A1 | 5/2004 | Nieuwstadt |
| 2006/0263285 | A1 | 11/2006 | Pollington et al. |
| 2007/0068142 | A1 | 3/2007 | Robel et al. |
| 2007/0144153 | A1 | 6/2007 | Gandhi et al. |
| 2007/0193254 | A1 | 8/2007 | Johannes |
| 2008/0103684 | A1 | 5/2008 | Allmer |
| 2008/0202097 | A1 | 8/2008 | Driscoll et al. |
| 2009/0056315 | A1 | 3/2009 | Solbrig et al. |
| 2009/0288394 | A1 | 11/2009 | Kasse et al. |
| 2010/0024397 | A1 | 2/2010 | Chi et al. |
| 2010/0058740 | A1 * | 3/2010 | Kurtz ..... 60/286 |

* cited by examiner

EMISSIONS REDUCTIONS THROUGH REGENT RELEASE CONTROL

CROSS-REFERENCE TO RELATED APPLICATION

The present application is a continuation of U.S. patent application Ser. No. 12/902,615 filed on Oct. 12, 2010, now issued as U.S. Pat. No. 8,689,542, which is incorporated herein by reference in its entirety.

TECHNICAL FIELD

The technical field generally relates to controlling emissions in diesel engines and more particularly relates to controlling excess reductant release from an aftertreatment catalyst.

BACKGROUND

Modern emissions requirements for many internal combustion engine have rendered aftertreatment systems necessary in many applications. Certain aftertreatment systems operate by storing a reagent—for example a $NO_x$ reductant—on a catalyst surface so that subsequent emissions may react with the stored reagent. However, presently available systems suffer from some drawbacks. The amount of reagent that can be stored on the catalyst is variable at different operating conditions, including variability with temperature. In certain systems, the storage capacity of the catalyst reduces with temperature to the extent that the reagent may be released unreacted. Many reagents are themselves regulated or considered undesirable materials for direct release into the atmosphere. Therefore, presently available systems must select between a variety of less desirable solutions, including oversizing the storage catalyst, adding a cleanup catalyst, operating the engine in a very conservative manner with inhibited performance, and allowing the aftertreatment system to operate as a less capable system while more aggressively reducing emissions in other areas such as during the combustion event. Each of these solutions increases expense, or decreases the performance and/or reliability of the application. Therefore, further technological developments are desirable in this area.

SUMMARY

One embodiment is a unique reagent reaction technique that neutralizes some of the stored reagent prior to a catalyst storage capacity change. Other embodiments include unique methods, systems, and apparatus to reduce reagent release amounts. Further embodiments, forms, objects, features, advantages, aspects, and benefits shall become apparent from the following description and drawings.

DESCRIPTION OF THE ILLUSTRATIVE EMBODIMENTS

Figure 1:
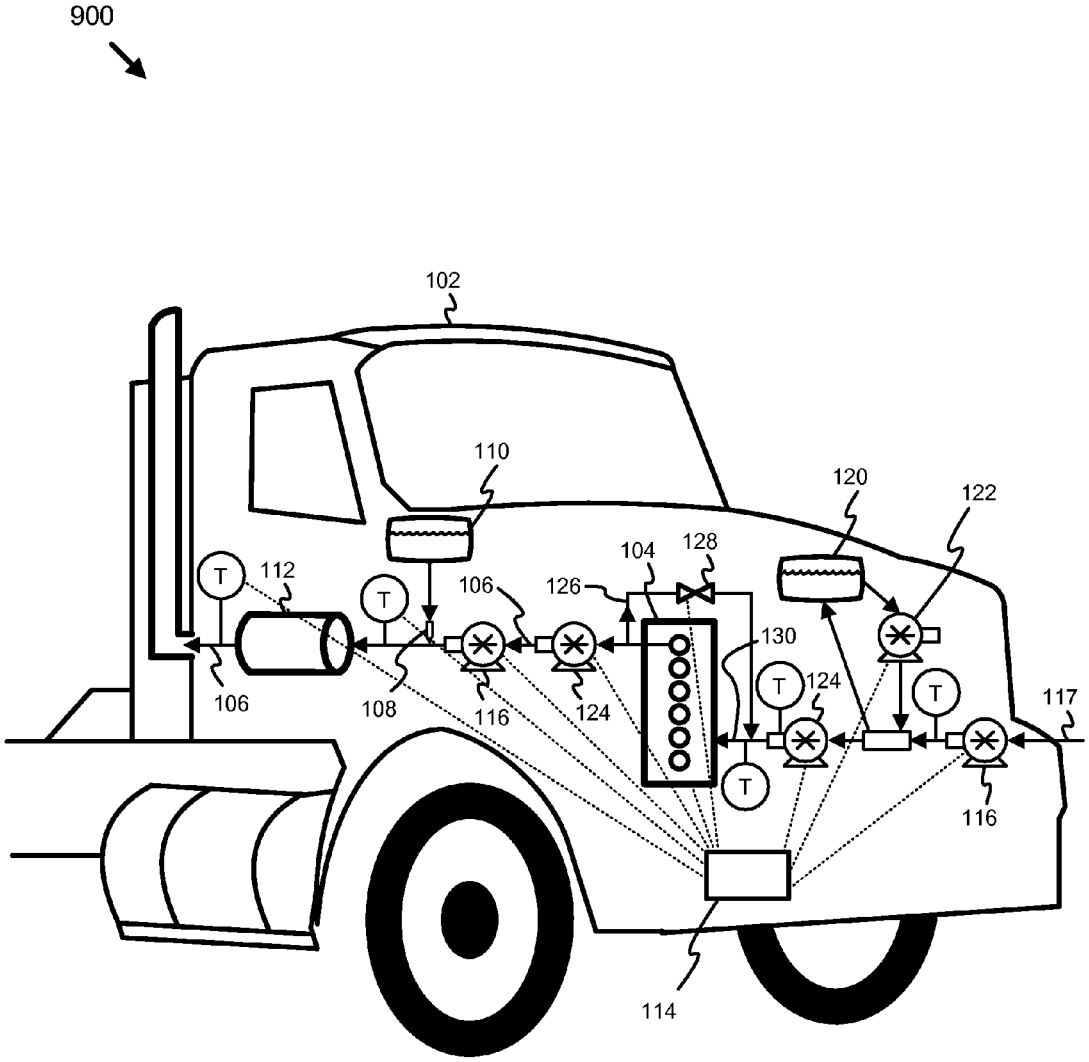
FIG. 1 is a schematic illustration of an application having a reagent release reduction system.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

FIG. 1 is a schematic illustration of a system 100 including an application 102 having a reagent release reduction system. The application 102 illustrated in FIG. 1 is a truck application including a diesel engine 104, although any application including a $NO_x$-generating engine 104 is contemplated herein. The system 100, in certain embodiments, includes the internal combustion engine 104 providing an exhaust stream 106 including an amount of $NO_x$. In certain embodiments, the system 100 includes a reductant introduction device 108 that introduces a reductant 110 into the exhaust stream 106. In certain embodiments, the reductant 110 includes ammonia and/or an ammonia precursor such as urea, or any NO reduction chemical. In certain embodiments, the system 100 further includes a reductant storage device 112 that stores reductant 110 during portions or all of the engine operations. The reductant storage device 112 includes a catalyst and a substrate, and in certain embodiments comprises a catalyst that adsorbs ammonia at certain temperatures and that releases ammonia at certain higher temperatures. In certain embodiments, the released ammonia reacts with NO coming from the engine 104, providing excess ammonia delivery capacity at certain operating points over what the reductant delivery device 108 provides. In certain embodiments, the reductant storage device 112 further includes other components of the exhaust system that may accumulate reductant—for example an exhaust pipe, a catalyst and/or other component such as a particulate filter (not shown).

In certain embodiments, the system 100 further includes a controller structured to perform certain operations to reduce emissions, including emitted reductant 110 that may pass unreacted from the system 100 with the exhaust stream 106. In certain embodiments, the controller 114 forms a portion of a processing subsystem including one or more computing devices having memory, processing, and communication hardware. The controller 114 may be a single device or a distributed device, and the functions of the controller may be performed by hardware or software.

In certain embodiments, the controller includes one or more modules structured to functionally execute the operations of the controller. In certain embodiments, the controller includes an ammonia storage module, an ammonia release prediction module, a $NO_x$ increase determination module, a $NO_x$ increase control module, a catalyst reaction rate module, and/or a catalyst degradation estimate module. The description herein including modules emphasizes the structural independence of the aspects of the controller 114, and illustrates one grouping of operations and responsibilities of the controller 114. Other groupings that execute similar overall operations are understood within the scope of the present application. Modules may be implemented in hardware and/or software on computer readable medium, and modules may be distributed across various hardware or software components. More specific descriptions of certain embodiments of controller 114 operations are included in the section referencing FIG. 3.

In certain embodiments, the internal combustion engine 104 includes a variable valve timing (VVT) system (not shown), and the amount of $NO_x$ provided by the engine by is increased by the controller 116 commanding the VVT system to increase an effective compression ratio and/or commanding the VVT system to reduce a combustion remainder in a combustion cylinder of the internal combustion engine. The use of a combustion remainder in the cylinder is sometimes termed "internal EGR," and a reduction of the combustion remainder in the cylinder reduces the amount of internal EGR.

In certain embodiments, the internal combustion engine 104 includes a turbocharger 116 and an intercooler 118. The turbocharger 116 is shown schematically distributed for clarity to physically separate the intake stream 117 from the exhaust stream 106 in FIG. 1, although the compressor side and turbo side of the turbocharger 116 are typically in close proximity within a housing connected by a shaft. In certain embodiments, the amount of $NO_x$ is increased by the controller 114 commanding an actuator structured to reduce a heat transfer rate of the intercooler 118. For example, the intercooler 118 may have a cooling fluid 120 (e.g. the radiator fluid) and a coolant pump 122, and the heat transfer rate of the intercooler 118 is reduced by the coolant pump 122 reducing delivery pressure of coolant to the intercooler 118. Any other method of reducing the intercooler 118 heat transfer rate is also contemplated herein, including at least bypassing coolant past all or a portion of the intercooler 118, operating a valve (not shown) to slow down flow through the intercooler 118, and/or bypassing all or a portion of the intake stream 117 past the intercooler 118. The effect of reducing heat transferred by the intercooler 118 is a higher intake manifold 130 temperature, resulting in a higher $NO_x$ generation by the engine 104.

In certain embodiments, the internal combustion engine 104 includes a first turbocharger 116 and a second turbocharger 124, and the amount of $NO_x$ provided by the engine 104 is increased by the controller 114 commanding the first turbocharger 116 and the second turbocharger 124 to redistribute compression burdens such that an intake manifold temperature 130 is increased. For example, in the illustration of FIG. 1, the second turbocharger 124 compresses the intake stream 117 downstream of the intercooler 118, and increasing the compression burden to the second turbocharger 124 as shown will increase the intake manifold 130 temperature at many operating conditions of the engine 104.

In certain embodiments, the internal combustion engine 104 includes a common rail fuel system (not shown), and amount of $NO_x$ provided by the engine 104 is increased by the controller 114 commanding the common rail fuel system to increase a fuel rail pressure. In certain embodiments, the internal combustion engine 104 includes a common rail fuel system, and the amount of $NO_x$ provided by the engine 104 is increased by the controller 114 commanding the common rail fuel system to manipulate a post fuel injection event and/or a pilot fuel injection event. For example, the controller 114 may change a timing and/or amount of the post fuel injection event and/or pilot fuel injection event to result in more fuel being delivered earlier relative to a nominal injection event, resulting in the generation of additional $NO_x$ at many operating conditions of the engine 104.

In certain embodiments, the internal combustion engine 104 includes a variable geometry turbocharger 116, and amount of $NO_x$ provided by the engine 104 is increased by the controller 114 by commanding the variable geometry turbocharger 116 to increase a charge pressure amount. In certain embodiments, the system further includes an exhaust gas recirculation (EGR) flow 126 and an EGR valve 128, and the amount of $NO_x$ provided by the engine 104 is increased by reducing an amount of the EGR flow 126.

In an alternate embodiment, the amount of $NO_x$ provided by the engine 104 is increased by increasing a temperature of recirculated exhaust gases introduced to the intake manifold. In one example, the EGR flow 126 is bypassed or partially bypassed around an EGR cooler (not shown). In another example, coolant flow on the cooling side of the EGR cooler is reduced such that the net heat transfer in the EGR cooler is lowered.

Figure 2A:
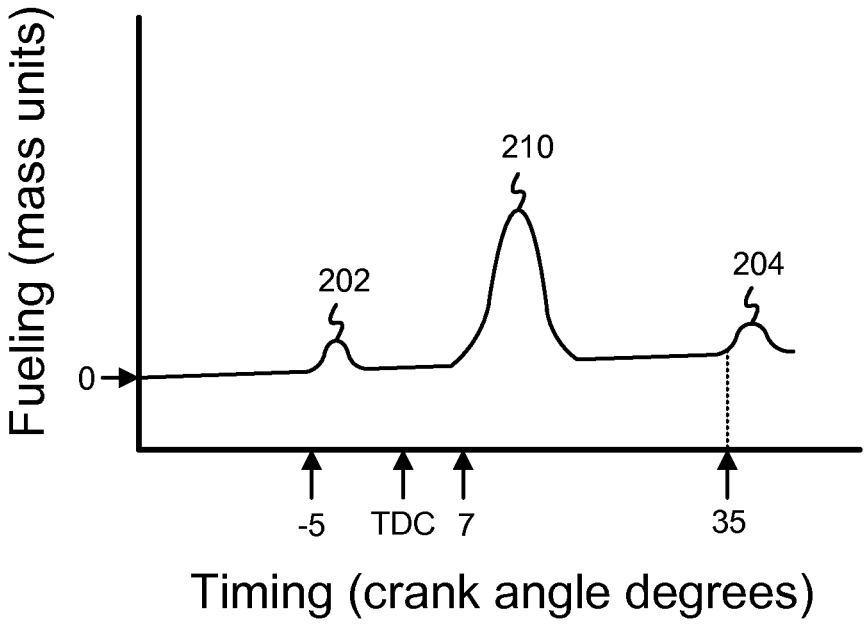
FIG. 2A is an illustration of nominal pilot and post injection events.
Figure 2B:
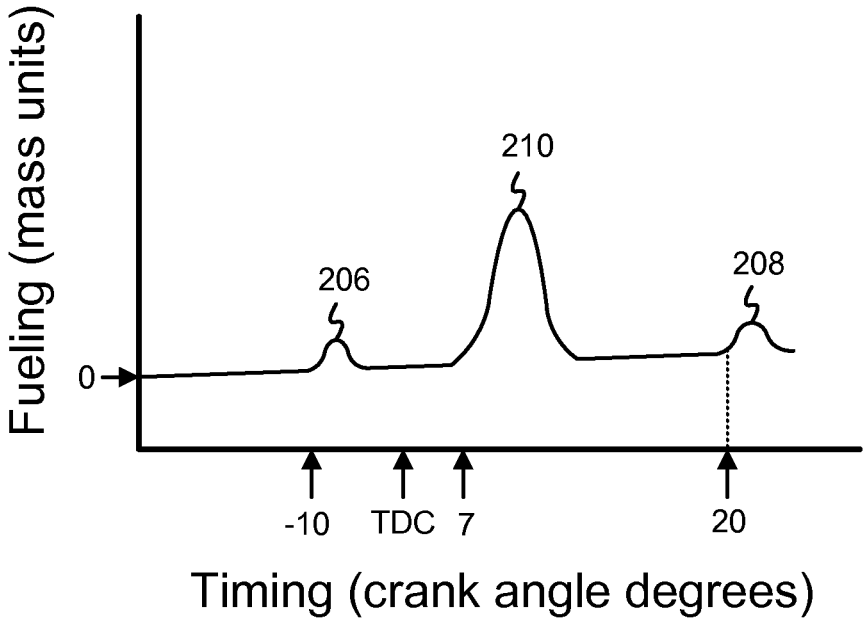
FIG. 2B is an illustration of adjusted pilot and post injection events.

FIG. 2A is an illustration of nominal pilot and post injection events. In the illustration of FIG. 2A, the pilot injection event 202 begins at approximately 5 degrees before top dead center (TDC), and the post injection event 204 begins at approximately 35 degrees after TDC. The illustration of FIG. 2B shows the pilot injection event 206 shifted to about 10 degrees before TDC and increased in magnitude relative to the nominal event 202. The illustration of FIG. 2B further shows the post injection event 208 shifted to about 20 degrees after TDC and shows the post injection event 208 with a similar magnitude relative to the nominal post injection event 204. In certain embodiments, adjustments to the pilot injection events 202, 206 have a stronger effect on $NO_x$ generation than adjustments to the post injection events 204, 208. Any further adjustments known in the art are contemplated herein, including without limitation adjustments to the pilot injection 202, post injection 204, and/or the main injection event 210 to maintain a similar torque output for the engine 104 that would otherwise be achieved by the nominal injection events 202, 204, 210.

Figure 3:
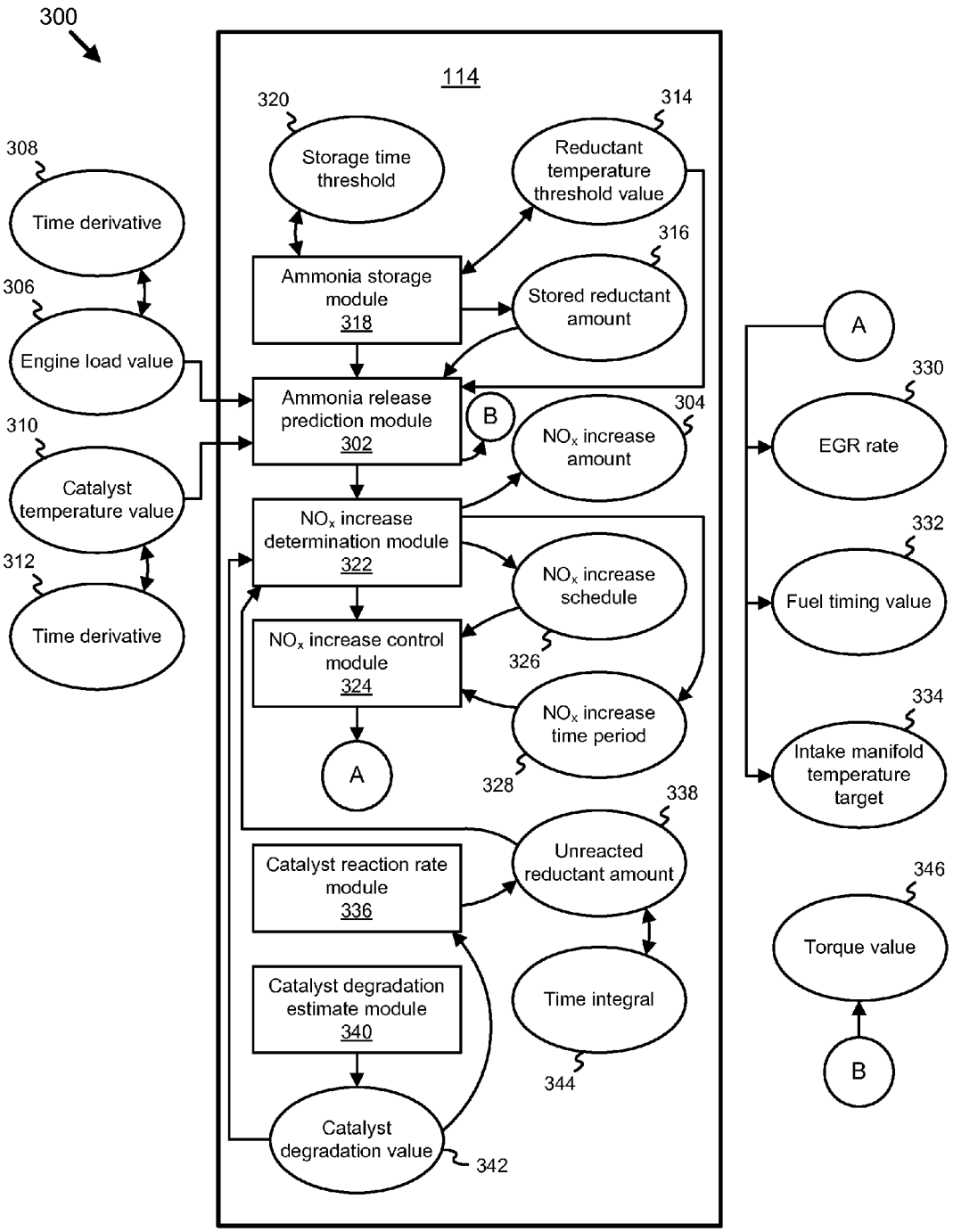
FIG. 3 is a schematic illustration of a processing subsystem.

FIG. 3 is a schematic illustration of a processing subsystem 300 including a controller 114.

In certain embodiments, the controller 114 includes a reductant storage module 318 (or ammonia storage module 218) that determines whether a reductant storage device 112 has a stored quantity of the reductant 110. In certain embodiments, the reductant storage module 318 determines whether the $NO_x$ reduction chemical storage device 112 has a stored quantity of the $NO_x$ reduction chemical 110. In certain embodiments, the reductant storage module 318 estimates an amount of reductant injected that remains in the exhaust pipe, catalyst, and/or other components. For example, the reductant storage module 318 may determine that a percentage of the injected reductant pools in the exhaust pipe, where the percentage is based on an ambient temperature, exhaust temperature, exhaust flow rate, and/or $NO_x$ reduction chemical injection rate. In certain embodiments, the reductant storage module 318 determines whether the $NO_x$ reduction chemical storage device has a stored quantity of the $NO_x$ reduction chemical by determining whether the $NO_x$ reduction chemical storage device has experienced a threshold amount of time (e.g. storage time threshold 220) at a temperature value below a $NO_x$ reduction chemical storage temperature threshold value 314. For example, the catalyst 112 may be known to store only a negligible amount of reductant at higher temperatures (e.g. above 275° C.), and the reductant storage module 318 may estimate that no reductant storage occurs above the threshold temperature 314. The threshold 314 described herein may be a single value, a range of values, and/or a function of values. For example, a given temperature may not release $NH_3$ initially from the catalyst, but may cause the release to occur over time, having the effect that the threshold 314 temperature reduces over time as the catalyst stays warm and begins to release the $NO_x$ reduction chemical. Additionally, at high levels of stored $NO_x$ reduction chemical, a threshold 314 temperature may be lower than at lower levels of stored $NO_x$ reduction chemical, as the increasing temperature reduces the storage capacity of the catalyst thereby releasing the stored $NO_x$ reduction chemical.

In certain embodiments, the controller 114 includes a reductant release prediction module 302 that determines an impending reductant release. In certain embodiments, the reductant release prediction module 302 determines an impending $NO_x$ reduction chemical release by determining that a load value 306 for the engine has increased beyond a threshold. For example, the load value 306 may be a torque or horsepower value known to make it very likely that an exhaust temperature will exceed the threshold temperature 314 and thereby release stored reductant, and the reductant release prediction module 302 determines that a reductant release is imminent when the engine 104 exceeds the load value 306. In certain embodiments, the engine load value 306 may use a filtered engine load, and/or the reductant release prediction module 302 may require the engine load exceed the load value 306 for a period of time before determining that a reductant release is imminent. In certain further embodiments, the reductant release prediction module 302 determines an impending $NO_x$ reduction chemical release by determining that a temperature value 310 for the catalyst has increased beyond a threshold. The temperature value 310 for the catalyst may be a different temperature than the reductant temperature threshold value 314, and may be a changing value during operations depending upon the amount of time at temperature and/or the amount of $NO_x$ reduction chemical stored on the catalyst, and further may include an absolute or relative temperature value. For example, an increase in catalyst temperature of 50° C. at almost any temperature may significantly change the catalyst 112 storage capacity and/or evaporate pooled reductant in an exhaust pipe, so in certain embodiments the reductant release prediction module 302 may determine that a reductant release is imminent when the exhaust temperature and/or catalyst temperature value 310 increases above a threshold. In certain embodiments, the reductant release prediction module 302 determines an imminent release of reductant based, either solely or additionally, on an engine load time derivative 308 and/or a catalyst temperature value time derivative 312.

In certain embodiments, the controller 114 includes a $NO_x$ increase determination module 322 that determines a $NO_x$ increase amount 304 in response to the stored quantity of the reductant, or stored reductant amount 316, and the impending reductant release. In certain embodiments, the $NO_x$ increase determination module 322 determines the $NO_x$ increase amount 304 as a $NO_x$ increase schedule 326 based on the stored quantity 316 of ammonia or reductant. In certain embodiments, the $NO_x$ increase schedule 326 is a specified $NO_x$ increase time period 328. In certain embodiments, the $NO_x$ increase schedule 326 is a $NO_x$ increase profile based upon an expected reductant release profile from the catalyst 112 and/or other source of stored reductant.

In certain embodiments, the controller 114 includes a NO increase control module 324 that increases a NO amount provided by the engine 104 in response to the NO increase amount 304. In certain embodiments, the NO increase control module 324 increases the NO emissions amount from the engine 104 by decreasing an EGR rate 330, advancing a fuel timing value 332, and/or increasing an intake manifold temperature value 334. In certain embodiments, the NO increase control module 324 increases the NO emissions amount from the engine 104 by increasing a fuel rail pressure, adjusting a post fuel injection event, adjusting a variable valve timing, increasing a charge pressure, adjusting a pilot fuel injection event, and/or adjusting an air-fuel ratio for the engine. In certain embodiments, the NO increase control module 324 increases the NO emissions amount from the engine 104 by reducing a combustion remainder in a combustion cylinder of the internal combustion engine, by reducing a heat transfer rate of an intercooler, by increasing a charge pressure amount, and/or by commanding a first turbocharger and a second turbocharger to redistribute compression burdens such that an intake manifold temperature is increased. In one exemplary embodiment, the ammonia release prediction module 302 predicts an ammonia release based on the stored reductant amount 316 and a nominal temperature determined according to operation conditions or requested operating conditions of the engine 104. The ammonia release prediction module 302 in the example commands a torque value 346 such that the exhaust temperature will not exceed a temperature that releases excessive ammonia from the catalyst.

In certain embodiments, the controller 114 further includes a catalyst reaction rate module 336 that determines an unreacted reductant amount 338, and the NO increase determination module 322 further determines the NO increase amount 304 in response to the unreacted reductant amount 338. The unreacted reductant amount 338 may be determined according to the incoming $NO_x$, reductant, and temperature of the catalyst 112 via kinetic modeling of the catalytic reaction, lookup tables based on experimental data, or through other reaction rate determination means. In certain embodiments, the reductant storage module further determines the NO reduction chemical storage device has a stored quantity of the NO reduction chemical 316 further by determining a time integral 344 of the unreacted NO reduction chemical amount 338 over time.

In certain embodiments, the controller 114 further includes a catalyst degradation estimate module 340 that determines a catalyst degradation value 342, and the catalyst reaction rate module 336 is further structured to determine the unreacted reductant amount in response to the catalyst degradation value 342. Catalyst degradation over time is readily modeled through aging techniques and data generally available from systems 100 in use. Degradation of the catalyst 112 affects the reaction rate of $NO_x$ with reductant passing through the exhaust, and further affects the storage capacity of the catalyst 112. In certain embodiments, the $NO_x$ increase determination module 322 decrements the specified $NO_x$ increase time period 328 based on the estimated catalyst degradation value 342. For example, the catalyst degradation value 342 may be determined to be a value that reduces the reaction rate of $NO_x$ with reductant, causing the unreacted reductant 338 to accumulate more quickly on the catalyst 112. Further, the catalyst degradation value 342 may be determined to be a value indicating diminished storage capacity of the catalyst, reducing the maximum value for the stored reductant amount 316. One or more catalyst degradation effects may be estimated in a particular system 100, and in certain systems 100 catalyst degradation may not be utilized.

Figure 4:
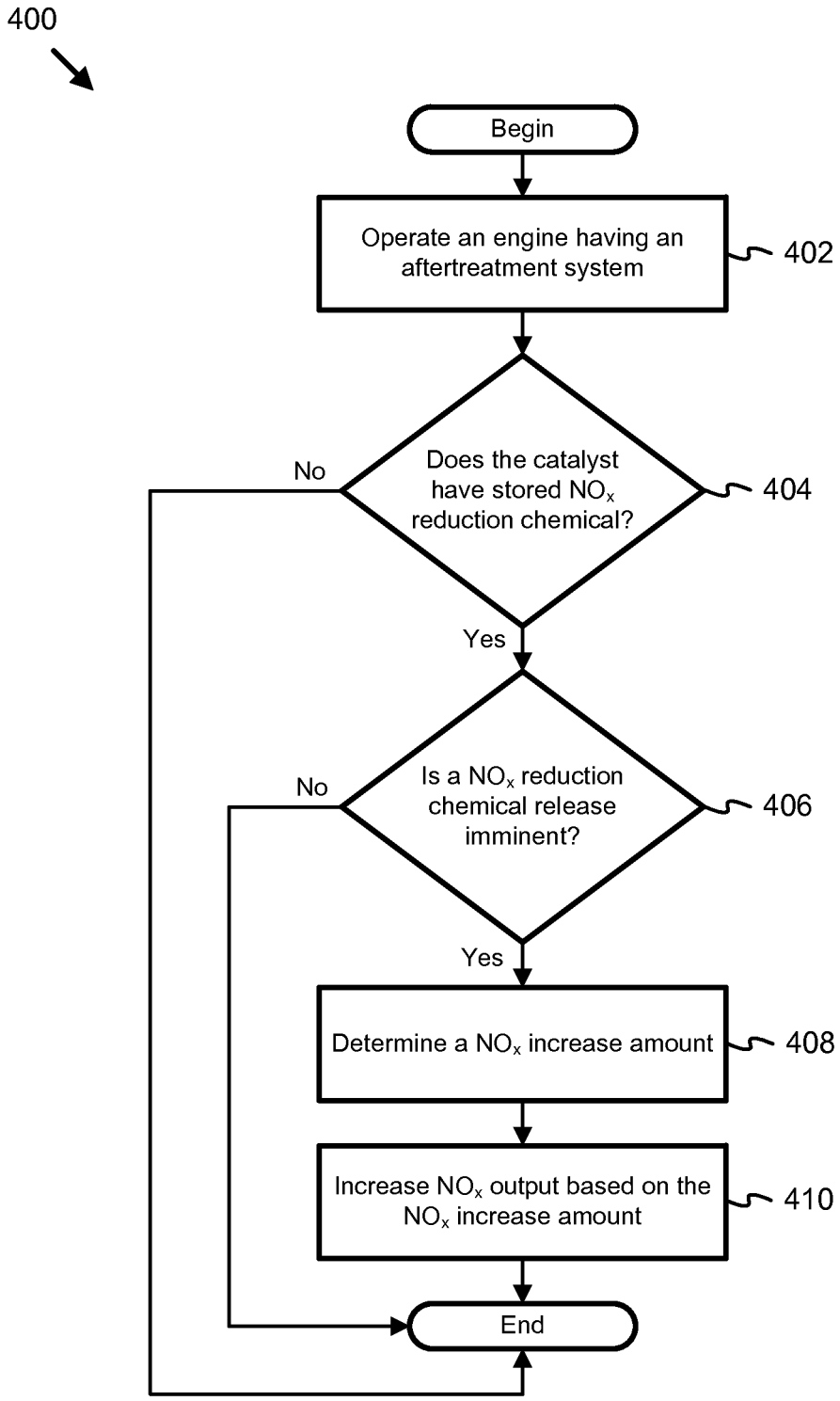
FIG. 4 is a schematic flow diagram of a technique for reducing reagent release.

FIG. 4 is a schematic flow diagram of a technique 400 for reducing reagent release. In certain embodiments, the technique 400 includes an operation 402 to operate an engine with an aftertreatment system, the aftertreatment system including a $NO_x$ reduction chemical storage device. In certain embodiments, the technique 400 further includes an operation 404 to determine whether the $NO_x$ reduction chemical storage device has stored reductant. In certain embodiments, if the $NO_x$ reduction chemical storage device has stored reductant, the technique 400 further includes an operation 406 to determine whether a reductant release is imminent. In certain embodiments, where a reductant release is imminent, technique 400 further includes an operation 408 to determine a $NO_x$ increase amount and an operation 410 to increase an engine $NO_x$ output based on the $NO_x$ increase amount.

Figure 5:
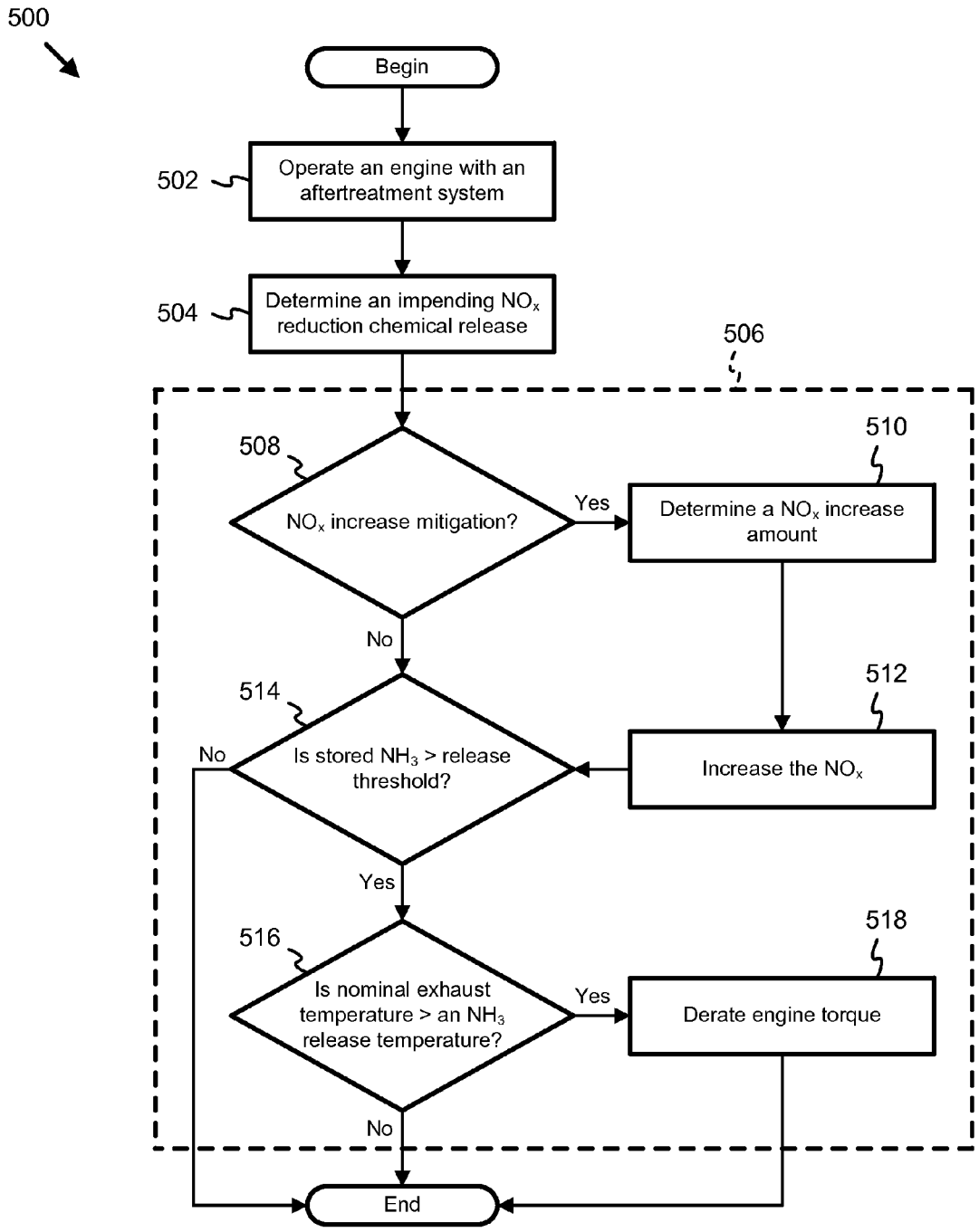
FIG. 5 is a schematic flow diagram of a procedure for mitigating an imminent ammonia emission.

FIG. 5 is a schematic flow diagram of a procedure 500 for mitigating an imminent ammonia emission. The procedure 500 includes an operation 502 to operate an engine with an aftertreatment system, the aftertreatment system including a $NO_x$ reduction chemical storage device. The procedure 500 includes an operation 504 to determine an impending $NO_x$ reduction chemical release from the $NO_x$ reduction chemical storage device, and an operation 506 to perform an $NH_3$ slip mitigation operation in response to the impending $NO_x$ reduction chemical release.

In one embodiment, the $NH_3$ slip mitigation operation 506 comprises a determination 508 whether a $NO_x$ increase mitigation is performed, and an operation 510 to determine a $NO_x$ increase amount and an operation 512 to increase $NO_x$ provided by the engine based on the $NO_x$ increase amount in response to the determination 508 with a positive (YES) result. In certain embodiments, the $NH_3$ slip mitigation operation 506 further includes an operation 514 determining that an amount of $NH_3$ stored on the $NO_x$ reduction chemical storage device exceeds a release threshold and an operation 516 determining that an engine operation request produces a nominal exhaust temperature higher than an $NH_3$ release temperature. In response to the operations 514, 516 having a positive (YES) determination, the $NH_3$ slip mitigation operation 506 further includes an operation 518 to derate an engine torque value such that the nominal exhaust temperature is shifted below the $NO_x$ release temperature. The nominal exhaust temperature includes an estimated exhaust temperature and/or a measured exhaust temperature.

For example, the operation 512 determining that an amount of $NO_x$ stored on the $NO_x$ reduction chemical storage device exceeds a release threshold includes a model or estimate that ammonia is stored on a $NO_x$ adsorption or selective catalytic reduction (SCR) catalyst in an amount that, if released, would exceed an allowable ammonia slip amount. The allowable ammonia slip amount is determined according to government regulations, industry standards, and/or requirements or requests by customers or marketing considerations. One simple model includes a determination that the catalyst is at a storage temperature for a specified period of time, although more sophisticated ammonia storage models are known in the art.

The nominal exhaust temperature may be a measured exhaust temperature, and/or may include an estimated exhaust temperature (e.g. a steady state estimate) according to current or requested engine operations. For example, an operator request may be for 1,000 foot-pounds (1,356 N-m) of torque, which may deliver a steady state temperature at other present operating conditions to yield an example nominal exhaust temperature of 400° F. (204° C.), even though the engine is presently producing less than 1,000 foot-pounds (1,356 N-m) of torque at lower exhaust temperature. The operation 518 to derate the engine operation includes selecting a torque value below the requested torque value such that the exhaust temperature (either presently measured or estimated steady state) stays below a temperature where the stored $NH_3$ would be released. The torque value may be raised to the operator request level as the amount of $NH_3$ stored on the catalyst is reduced.

As is evident from the figures and text presented above, a variety of embodiments according to the present invention are contemplated.

One embodiment is a method including operating an engine with an aftertreatment system, the aftertreatment system including a $NO_x$ reduction chemical storage device, and determining a $NO_x$ increase amount in response to an impending $NO_x$ reduction chemical release from the $NO_x$ reduction chemical storage device. In certain embodiments, the method further includes increasing $NO_x$ provided by the engine based on the $NO_x$ increase amount. In certain embodiments, the method further includes determining the impending $NO_x$ reduction chemical release by determining that a load value for the engine has increased beyond a threshold. In certain further embodiments, the method includes determining the impending $NO_x$ reduction chemical release by determining that a temperature value for the catalyst has increased beyond a threshold.

In certain embodiments, the method includes determining whether the $NO_x$ reduction chemical storage device has a stored quantity of the $NO_x$ reduction chemical, and wherein the $NO_x$ reduction chemical storage device comprises at least one of a catalyst and an exhaust pipe. In certain embodiments, determining whether the $NO_x$ reduction chemical storage device has a stored quantity of the $NO_x$ reduction chemical includes determining whether the $NO_x$ reduction chemical storage device has experienced a threshold amount of time at a temperature value below a $NO_x$ reduction chemical storage temperature threshold value. In certain embodiments, the determining whether the $NO_x$ reduction chemical storage device has a stored quantity of the $NO_x$ reduction chemical further includes integrating an unreacted NO reduction chemical amount over a period of time. In certain embodiments, increasing a NO emissions amount from an engine includes decreasing an EGR rate, advancing a fuel timing value, and/or increasing an intake manifold temperature value.

One embodiment is a method including determining whether an ammonia storage device has a stored quantity of ammonia, predicting an impending ammonia release from the ammonia storage device, determining a NO increase amount in response to the impending ammonia release, and increasing an amount of NO provided by an engine based on the NO increase amount. In certain embodiments, determining the NO increase amount in response to the impending ammonia release comprises determining a NO increase schedule based on the stored quantity of ammonia. In certain embodiments, the NO increase schedule comprises a specified NO increase time period, and in certain further embodiments, the method further includes decrementing the specified NO increase time period based on an estimated catalyst degradation value.

In certain embodiments, predicting an impending ammonia release from the ammonia storage device includes determining whether a rate of temperature increase of the ammonia storage device exceeds a threshold rate of temperature increase value. In certain embodiments, predicting an impending ammonia release from the ammonia storage device includes determining whether a rate of engine load increase exceeds a threshold rate of engine load increase. In certain embodiments, increasing an amount of NO provided by an engine includes decreasing an exhaust gas recirculation rate, advancing a fuel timing value, and/or increasing an intake manifold temperature value. In certain embodiments, increasing an amount of NO provided by an engine includes increasing a fuel rail pressure, adjusting a post fuel injection event, adjusting a variable valve timing, increasing a charge pressure, adjusting a pilot fuel injection event, and/or adjusting an air-fuel ratio for the engine.

One exemplary embodiment is a system, including an internal combustion engine providing an exhaust stream including an amount of $NO_x$, an ammonia introduction device structured to introduce one of ammonia and an ammonia precursor into the exhaust stream, an ammonia storage device that stores ammonia during at least a portion of the engine operation, and a controller structured to perform operations. In certain embodiments, the operations include an operation to determine whether an ammonia storage device has a stored quantity of ammonia, an operation to predict an impending ammonia release from the ammonia storage device, an operation to determine a $NO_x$ increase amount in response to the impending ammonia release, and an operation to increase an amount of $NO_x$ provided by an engine based on the $NO_x$ increase amount.

In certain embodiments, the internal combustion engine includes a variable valve timing (VVT) system, and controller is further structured to perform an operation to increase the amount of $NO_x$ provided by the engine by commanding the VVT system to increase an effective compression ratio or commanding the VVT system to reduce a combustion remainder in a combustion cylinder of the internal combustion engine. In certain embodiments, the internal combustion engine includes a turbocharger and an intercooler, and the controller is further structured to perform an operation to increase the amount of $NO_x$ provided by the engine by commanding an actuator structured to reduce a heat transfer rate of the intercooler. In certain embodiments, the internal combustion engine includes a first turbocharger and a second turbocharger, and the controller is further structured to perform an operation to increase the amount of $NO_x$ provided by the engine by commanding the first turbocharger and the second turbocharger to redistribute compression burdens such that an intake manifold temperature is increased.

In certain embodiments, the internal combustion engine includes a common rail fuel system, and the controller is further structured to perform an operation to increase the amount of $NO_x$ provided by the engine by commanding the common rail fuel system to increase a fuel rail pressure. In certain embodiments, the internal combustion engine includes a common rail fuel system, and the controller is further structured to perform an operation to increase the amount of $NO_x$ provided by the engine by commanding the common rail fuel system to manipulate a post fuel injection event. In certain embodiments, the internal combustion engine includes a common rail fuel system, and the controller is further structured to perform an operation to increase the amount of $NO_x$ provided by the engine by commanding the common rail fuel system to manipulate a pilot fuel injection event.

In certain embodiments, the internal combustion engine includes a variable geometry turbocharger, and the controller is further structured to perform an operation to increase the amount of $NO_x$ provided by the engine by commanding the variable geometry turbocharger to increase a charge pressure amount. In certain embodiments, the system further includes an exhaust gas recirculation (EGR) flow and an EGR valve, and the controller is further structured to perform an operation to increase the amount of $NO_x$ provided by reducing an amount of the EGR flow.

One exemplary embodiment is an apparatus including an reductant storage module structured to determine whether a reductant storage device has a stored quantity of the reductant, a reductant release prediction module structured to determine an impending reductant release, a $NO_x$ increase determination module structured to determine a $NO_x$ increase amount in response to the stored quantity of the reductant and the impending reductant release, and a $NO_x$ increase control module structured to increase a $NO_x$ amount provided by an engine in response to the $NO_x$ increase amount. In certain embodiments, the apparatus further includes a catalyst reaction rate module structured to determine an unreacted reductant amount, and the $NO_x$ increase determination module is further structured to determine the $NO_x$ increase amount in response to the unreacted reductant amount. In certain embodiments, the apparatus further includes a catalyst degradation estimate module structured to determine a catalyst degradation value, and the catalyst reaction rate module is further structured to determine the unreacted reductant amount in response to the catalyst degradation value.

In certain embodiments, the reductant release prediction module is further structured to determine the impending reductant release in response to at least one of an engine load value and a catalyst temperature value. In certain embodiments, the reductant release prediction module is further structured to determine the impending reductant release in response to at least one of a time derivative of an engine load value and a time derivative of a catalyst temperature value.

Yet another exemplary embodiment is a method comprising operating an engine with an aftertreatment system, the aftertreatment system including a $NO_x$ reduction chemical storage device, and in response to an impending $NO_x$ reduction chemical release from the $NO_x$ reduction chemical storage device, performing an $NH_3$ slip mitigation operation. In a further embodiment, the $NH_3$ slip mitigation operation includes determining a $NO_x$ increase amount and increasing $NO_x$ provided by the engine based on the $NO_x$ increase amount. In an alternate or additional embodiment, the $NH_3$ slip mitigation operation includes determining the impending $NO_x$ reduction chemical release by determining that an amount of $NO_x$ stored on the $NO_x$ reduction chemical storage device exceeds a release threshold and determining that an engine operation request produces a nominal exhaust temperature higher than a $NO_x$ release temperature, and derating an engine torque value such that the nominal exhaust temperature is shifted below the $NO_x$ release temperature. The nominal exhaust temperature includes an estimated exhaust temperature and/or a measured exhaust temperature.

While the invention has been illustrated and described in detail in the drawings and foregoing description, the same is to be considered as illustrative and not restrictive in character, it being understood that only certain exemplary embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

an internal combustion engine providing an exhaust stream including an amount of $NO_x$;

an ammonia introduction device structured to introduce one of ammonia and an ammonia precursor into the exhaust stream;

an ammonia storage device that stores ammonia during at least a portion of the engine operation, wherein the ammonia storage device includes a catalyst;

a controller structured to:

determine whether an ammonia storage device has a stored quantity of ammonia;

predict an impending ammonia release from the ammonia storage device by determining that a load value for the engine has increased beyond a threshold;

determine a $NO_x$ increase amount in response to the impending ammonia release; and increase an amount of NO provided by an engine based on the $NO_x$ increase amount.

2. The system of claim 1, wherein the internal combustion engine includes a variable valve timing (VVT) system, and wherein the controller is further structured to increase the amount of $NO_x$ provided by the engine by one of commanding the VVT system to increase an effective compression ratio and commanding the VVT system to reduce a combustion remainder in a combustion cylinder of the internal combustion engine.

3. The system of claim 1, wherein the internal combustion engine includes a turbocharger and an intercooler, and wherein the controller is further structured to increase the amount of NO provided by the engine by commanding an actuator structured to reduce a heat transfer rate of the intercooler.

4. The system of claim 1, wherein the internal combustion engine includes a first turbocharger and a second turbocharger, and wherein the controller is further structured to increase the amount of $NO_x$ provided by the engine by commanding the first turbocharger and the second turbocharger to redistribute compression burdens such that an intake manifold temperature is increased.

5. The system of claim 1, wherein the internal combustion engine includes a common rail fuel system, and wherein the controller is further structured to increase the amount of $NO_x$ provided by the engine by commanding the common rail fuel system to increase a fuel rail pressure.

6. The system of claim 1, wherein the internal combustion engine includes a common rail fuel system, and wherein the controller is further structured to increase the amount of $NO_x$ provided by the engine by commanding the common rail fuel system to manipulate a post fuel injection event.

7. The system of claim 1, wherein the internal combustion engine includes a common rail fuel system, and wherein the controller is further structured to increase the amount of $NO_x$ provided by the engine by commanding the common rail fuel system to manipulate a pilot fuel injection event.

8. The system of claim 1, wherein the internal combustion engine includes a variable geometry turbocharger, and wherein the controller is further structured to increase the amount of $NO_x$ provided by the engine by commanding the variable geometry turbocharger to increase a charge pressure amount.

9. The system of claim 1, further comprising an exhaust gas recirculation (EGR) flow and an EGR valve, and wherein the controller is further structured to increase the amount of $NO_x$ provided by reducing an amount of the EGR flow.

10. The system of claim 1, wherein the controller is further structured to determine whether the ammonia storage device has experienced a threshold amount of time at a temperature value below an ammonia storage temperature threshold value to determine whether the ammonia storage device has the stored quantity of ammonia.

* * * * *